US008840482B2

(12) United States Patent
Choi

(10) Patent No.: US 8,840,482 B2
(45) Date of Patent: Sep. 23, 2014

(54) LOW GROUND CLEARANCE-TYPE BALL SUPPLY DEVICE

(75) Inventor: Song Hwan Choi, Daejeon (KR)

(73) Assignee: RD-Tek Co., Ltd., Daejeon (KR)

( * ) Notice: Subject to any disclaimer, the term of this patent is extended or adjusted under 35 U.S.C. 154(b) by 0 days.

(21) Appl. No.: 13/822,393

(22) PCT Filed: Sep. 7, 2011

(86) PCT No.: PCT/KR2011/006597

§ 371 (c)(1),
(2), (4) Date: Mar. 12, 2013

(87) PCT Pub. No.: WO2012/036405

PCT Pub. Date: Mar. 22, 2012

(65) Prior Publication Data

US 2013/0172092 A1 Jul. 4, 2013

(30) Foreign Application Priority Data

Sep. 15, 2010 (KR) ..... 10-2010-0090630

(51) Int. Cl.

| | |
|---|---|
| ***A63B 69/36*** | (2006.01) |
| ***A63B 69/00*** | (2006.01) |
| ***A63B 57/00*** | (2006.01) |
| *A63B 47/00* | (2006.01) |

(52) U.S. Cl.

CPC ..... *A63B 69/36* (2013.01); *A63B 2047/004* (2013.01); *A63B 69/0075* (2013.01); *A63B 57/0006* (2013.01)

USPC ..... 473/132; 473/134; 473/137

(58) Field of Classification Search

CPC ..... A63B 57/0006; A63B 69/36; A63B 2047/002

USPC ..... 473/132–137

See application file for complete search history.

(56) References Cited

U.S. PATENT DOCUMENTS 2,198,968 A * 4/1940 Jewett ..... 473/137
3,423,097 A * 1/1969 Fry ..... 473/136

(Continued)

FOREIGN PATENT DOCUMENTS

KR 20-1999-0004010 Y1 1/1999
KR 10-0202976 B1 6/1999

(Continued)

OTHER PUBLICATIONS

International Search Report for International Application No. PCT/KR2011/006597 which corresponds to the above-identified U.S. application.

(Continued)

*Primary Examiner* — Steven Wong
(74) *Attorney, Agent, or Firm* — LRK Patent Law Firm

(57) ABSTRACT

A ball supply device where a ball is automatically supplied to a designated position is provided. The ball supply device includes a mat unit having an inclined surface and a hole, where a ball provided along the inclined surface is positioned; a tee member lifted up and down along an axial line of the hole in the mat unit and moving the ball positioned in the hole to a tee shot position at a spot that is upwardly spaced from a plane of the mat unit; a loading unit located on a plane lower than the mat unit and moving the ball loaded thereon to the mat unit; and a feeding member positioned between the loading unit and the mat unit and providing balls, which are provided from the loading unit one by one, to the inclined surface of the mat unit by performing a swing motion within a range.

19 Claims, 5 Drawing Sheets

(56) References Cited

U.S. PATENT DOCUMENTS

| | | | | |
|---|---|---|---|---|
| 3,448,985 | A * | 6/1969 | Scott | 473/136 |
| 4,602,789 | A * | 7/1986 | Chung | 473/137 |
| 4,934,697 | A * | 6/1990 | Shiau | 473/136 |
| 4,981,299 | A * | 1/1991 | Petrillo | 473/136 |
| 5,549,517 | A * | 8/1996 | Ikemoto | 473/134 |
| 5,603,664 | A * | 2/1997 | Provost | 473/134 |
| 5,733,209 | A * | 3/1998 | McIntyre, IV | 473/436 |
| 7,059,969 | B2 * | 6/2006 | Howe et al. | 473/137 |
| 2011/0092302 | A1 * | 4/2011 | Cho | 473/137 |

FOREIGN PATENT DOCUMENTS

| | | | |
|---|---|---|---|
| KR | 10-0329976 | B1 | 3/2002 |
| KR | 20-0296187 | Y1 | 11/2002 |
| KR | 10-0506155 | B1 | 7/2005 |
| KR | 10-0953356 | B1 | 4/2010 |
| KR | 10-0958294 | B1 | 5/2010 |

OTHER PUBLICATIONS

KIPO Office Action for Korean Patent Application No. 10-2010-0090630 which corresponds to the above-identified U.S. application.

KIPO Notice of Allowance for Korean Patent Application No. 10-2010-0090630 which corresponds to the above-identified U.S. application.

* cited by examiner (a)

(b)

(a)

(b)

LOW GROUND CLEARANCE-TYPE BALL SUPPLY DEVICE

TECHNICAL FIELD

The present invention relates to a ball supply device which automatically supplies a ball (golf ball) to a designated position for a tee shot, and, more particularly, to a low-ground clearance-type ball supply device which is not exposed on the floor where a ball is placed and has high space utilization.

BACKGROUND ART

Recently, as the interest in golf increases, a virtual golf simulation system, referred to as a so-called "screen golf", has emerged. The virtual golf simulation system provides a virtual reality which makes an indoor user feel as if he or she actually plays a golf game on a golf course.

Well known golf simulation systems generally include a screen golf booth with a space of a predetermined size. Images provided by the golf simulation system are projected on a screen provided in front of the booth. Accordingly, when a golfer hits a ball toward the screen, a golf ball image is projected on the screen such that the golfer can enjoy a virtual reality with the projected image.

The above-described screen golf system generally employs a golf ball automatic supply device for the purpose of convenience of golfers. The golf ball automatic supply device enables to supply golf balls one by one to a designated hitting position and, at the same time, to collect the golf balls flight by hitting to be supplied to a tee box.

Various types of conventional golf ball automatic supply devices have been developed and used in practice. Examples thereof include golf ball supply devices disclosed in Korean Patent No. 0953356 and Korean Patent No. 0506155. The golf ball supply devices disclosed in the prior art literatures have different configurations. However, their technical problems are the same in that they are configured to supply golf balls collected in one place to a designated hitting position one by one.

As such, the conventional golf ball automatic supply devices are configured to supply golf balls collected in one place to a designated hitting position one by one. However, most of various other types of conventional golf ball supply devices including the above prior arts disclosed in the above-mentioned literatures are located around the floor where the ball is placed due to the structural nature of such devices.

For example, in the case of a tee box for a right-handed golfer, the golf ball supply device is located opposite to the tee box with respect to a central mat, on which the golf ball is placed, to supply the golf ball to a designated position. That is, most of the conventional golf ball supply devices are installed opposite to the tee box where a golfer is positioned with respect to the central mat where the ball is placed.

Accordingly, in the case of most of the conventional screen golf systems, the tee box is limited to left or right according to either a left-handed golfer or a right-handed golfer. In other words, the right-handed golfer can enjoy the screen golf only in a space where the tee box for the right-handed golfer is provided, and the left-handed golfer can enjoy the screen golf only in a space where the tee box for the left-handed golfer is provided, which is problematic.

Thus, a tee box structure that can be used by both left-handed and right handed golfers in a single space is required to solve this problem, but the structure of the above-mentioned golf ball supply device for supplying the ball to a designated hitting position should be first improved to implement the above-described tee box structure.

DISCLOSURE

Technical Problem

Accordingly, the present invention has been made to solve the above-described problems, and an object of the present invention is to provide a low-ground clearance-type ball supply device which has structural features advantageous for implementation of a tee box for both left-handed and right handed golfers in which both left-handed and right handed golfers can enjoy a screen golf in a single space.

Moreover, another object of the present invention is to provide a low-ground clearance-type ball supply device which is not exposed on the floor and thus ensures much more clearance around a mat unit on which a ball is placed.

Technical Solution

To accomplish the above objects of the present invention, there is provided a low-ground clearance-type ball supply device configured to supply balls (golf balls) to a designated position one by one, the device comprising: a mat unit which includes an inclined surface and a hole on which a ball provided along the inclined surface is located; a tee member which is lifted up and down along an axial line of the hole in the mat unit and moves the ball located on the hole to a tee shot position spaced a predetermined distance upwardly from a plane of the matt unit; a loading unit which is located on a plane lower than the mat unit and moves the ball loaded thereon to the mat unit; and a feeding member which is located between the loading unit and the mat unit and provides balls, which are provided from the loading unit one by one, to the inclined surface of the mat unit by a swing motion within a certain range.

According to an embodiment of the present invention, the device may further comprise a tee-up driving unit which moves up and down the tee member.

In this case, the tee-up driving unit may comprise: a drive motor which operates in forward and reverse rotation within a certain rotation angle range; and an electrically-driven member which converts the rotational force by the drive motor into the up and down movement of the tee member.

Moreover, in this embodiment, the tee member may comprise a sensor which detects a ball placed on the hole in a state where the tee member is located below the mat unit and, at this time, the tee-up driving unit may be operated based on a detection command of the sensor such that the tee member can be operated to raise the ball located on the hole.

Furthermore, in this embodiment, the loading unit may be a transfer device in the form of a conveyor belt that performs an intermittent step motion at a pitch suitable to supply the ball loaded thereon to the feeding member one by one.

In a preferred embodiment, the loading unit may comprise: a driving drum; a driven drum spaced a predetermined distance from the driving drum; and a belt body connecting the driving drum and the driven drum, and a plurality of guide members may be formed on the surface of the belt body at intervals suitable to move the balls one by one from one side of the belt body to the other side.

Moreover, the feeding member applied in this embodiment may comprise: an operating arm which performs a swing motion in a clockwise or counterclockwise direction within a certain range with respect to a hinge point at one end thereof; and a feeding arm which is curved in the form of a hook from the other end of the operating arm and includes a receiving surface on which the ball provided one by one by the loading unit is placed.

Here, the receiving surface of the feeding arm may be curved with a radius of curvature corresponding to the radius of the ball placed on the receiving surface such that, when the feeding unit performs the swing motion while the ball is placed on the receiving surface, the ball does not fall from the receiving surface and maintains a stable loaded state.

Furthermore, according to an embodiment of the present invention, the device may further comprise; a first sensor which controls the intermittent step motion of the loading unit; and a second sensor which is involved in the swing motion of the feeding member.

In this case, the first sensor may be disposed at an end of the loading unit so as to detect a ball placed on the belt body at the end of the loading unit before the ball is provided from the loading unit to the feeding member and thus to control the intermittent step motion of the loading unit.

Moreover, the second sensor may be disposed near the feeding member at a height corresponding to the ball raised by the loading member when feeding member is located in a position suitable to receive the ball from the loading unit so as to detect the ball provided from the loading unit and placed on the feeding member and to control the operation of the feeding member based on the detection.

Advantageous Effects

According to the above-described embodiments of the present invention, the ball supply device of the present invention can be embedded on the floor in such a manner that the loading member supplying the balls is located on a plane lower than the mat unit where the ball is finally placed. Accordingly, the overall configuration of the device is not exposed on the floor or around the tee box, and thus it is possible to ensure much more clearance around the mat unit where the ball is placed.

Moreover, as the clearance is provided around the mat unit in the above manner, it is possible to provide an independent tee box space in both left and right sides with respect to the mat unit when the screen golf system is implemented, and thus it is advantageous to implement a tee box for both left-handed and right handed golfers.

Furthermore, when the device is provided below the mat unit, the device can be built at a lower height due to the application of the loading unit in the form of a conveyor belt. Accordingly, a high around clearance is not required during installation of the device, and thus the device has no space restraints for the installation.

MODE FOR INVENTION

Hereinafter, preferred embodiments in accordance with the present invention will be described with reference to the accompanying drawings. In describing the present invention, a detailed description of related known functions or configuration will be omitted so as not to obscure the gist of the present invention.

Figure 1:
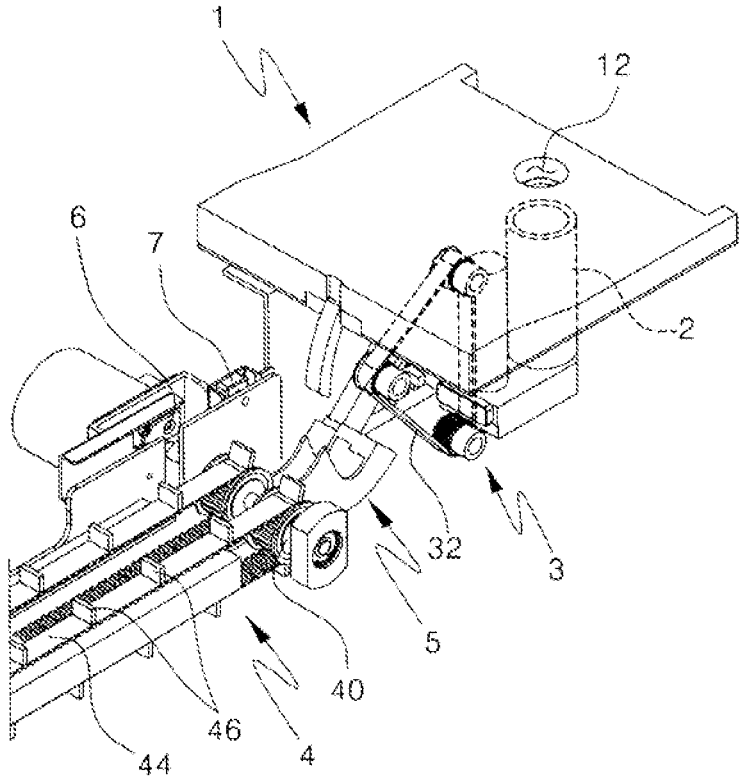
FIG. 1 is a perspective view of a low-ground clearance-type ball supply device in accordance with an embodiment of the present invention.
Figure 2:
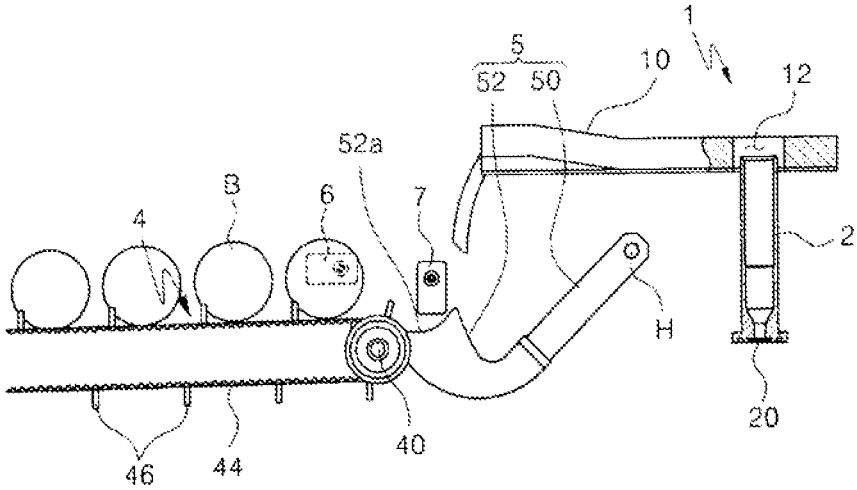
FIG. 2 is a schematic side view showing the overall configuration of the ball supply device shown in FIG. 1.

FIG. 1 is a perspective view of a low-ground clearance-type ball supply device in accordance with an embodiment of the present invention, and FIG. 2 is a schematic side view shotzing the overall configuration of the ball supply device shown in FIG. 1.

Referring to FIGS. 1 and 2, a ball supply device in accordance with an embodiment of the present invention comprises a mat unit 1, a loading unit 4 and a feeding member 5, which are configured to supply a golf ball (hereinafter, referred to as a "ball") on the mat unit 1. The mat unit 1 corresponds to a plane on which the ball to be hit, is substantially placed, and the loading unit 4 provides collected balls to the feeding member 5 one by one. Moreover, the feeding member 5 supplies the ball provided from the loading unit 4 to the mat unit 1 in response to a user's command input.

Next, the configuration of the present invention will be described in more detail.

The mat unit 1 includes an inclined surface 10 on one side thereof where the ball is received from the feeding member 5. Moreover, the mat unit 1 includes a hole 12 formed at a designated position where the ball for a tee shot is to be located. Here, the hole 12 is located on a path of the ball that is moved along the inclined surface 10 to the plane of the mat unit 1. Accordingly, the ball provided to the top of the inclined surface 10 by the feeding member 5 may roll down along the inclined surface 10 and be located on the hole 12.

A tee member 2 is mounted in the hole 12. The tee member 2 performs an up and down movement to be moved downward inside the hole 12 along an axial line of the hole 12 or moved upward outside the hole 12. Accordingly, when the tee member 2 is moved outside the hole 12 in a state where the ball is placed on the hole 12, the ball placed on the hole 12 can be moved to a tee shot position spaced a predetermined distance from the plane of the mat unit 1.

The tee member 2 may include a sensor 20 inside thereof. The sensor 20 detects a ball placed on the hole 12 in a state where the tee member 2 is located below the mat unit 1 and controls the up and down movement of the tee-member 2 based on the detected signal. Here, the control of the up and down movement of the tee member 2 by the sensor 20 may be implemented by a tee-up driving unit 3 schematically shown in FIG. 3.

Figure 3:
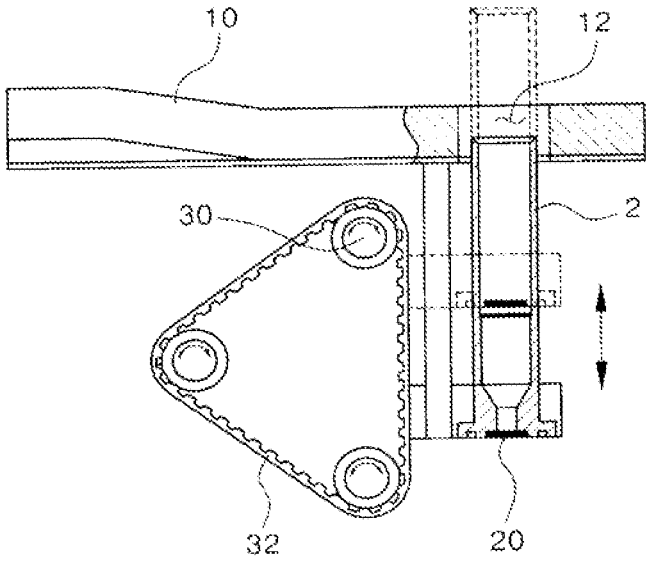
FIG. 3 is a schematic view showing the configuration of a tee-up driving unit applied to the present invention.

The tee-up driving unit 3 may preferably comprise, as shown in FIG. 3, a drive motor 30 which operates in forward and reverse rotation within a certain rotation angle range and an electrically-driven member 32 which converts the rotational force by the drive motor 30 into the up and down movement of the tee member 2. Here, the drive motor 30 may be operated based on a detection command of the sensor 20.

Accordingly, when the ball is placed on the hole 12 in a state where the tee member 2 is moved downward inside the hole 12, the sensor 20 detects the ball placed on the hole 12 and outputs a command signal for operation of the drive motor 30 based on the detected signal. As a result, the drive motor 30 operates based on the detected signal of the sensor 20 to move up the tee member 2, and the tee member 2 raises the ball placed on the hole 12 and places the ball at a designated tee shot position.

The tee-up driving unit 3 is not limited to the above-mentioned configuration including the motor 30 and the electrically-driven member 32. For example, any configuration capable of moving up and down the tee member 2, such as a linear motor or rack-pinion type lift device, is applicable without being limited to a specific form or structure. Accordingly, it is contemplated that such variations would also fall within the scope of the present invention.

The loading unit 4 serves to move the collected balls, after hitting, toward the mat unit 1. The loading unit 4 applied in this embodiment is located on a plane lower than the mat unit 1 and performs an intermittent step motion at a pitch suitable to load the collected balls and supply the balls to the feeding member 5 one by one.

The configuration of the loading unit 4 is not particularly limited as long as it can supply the balls to the feeding member 5 one by one. However, as a preferred example, the loading unit 4 may be implemented in the form of a conveyor belt as shown in the figures. The configuration of the conveyor belt-type loading unit 4 will be described in more detail with reference to FIG. 4 below.

Figure 4:
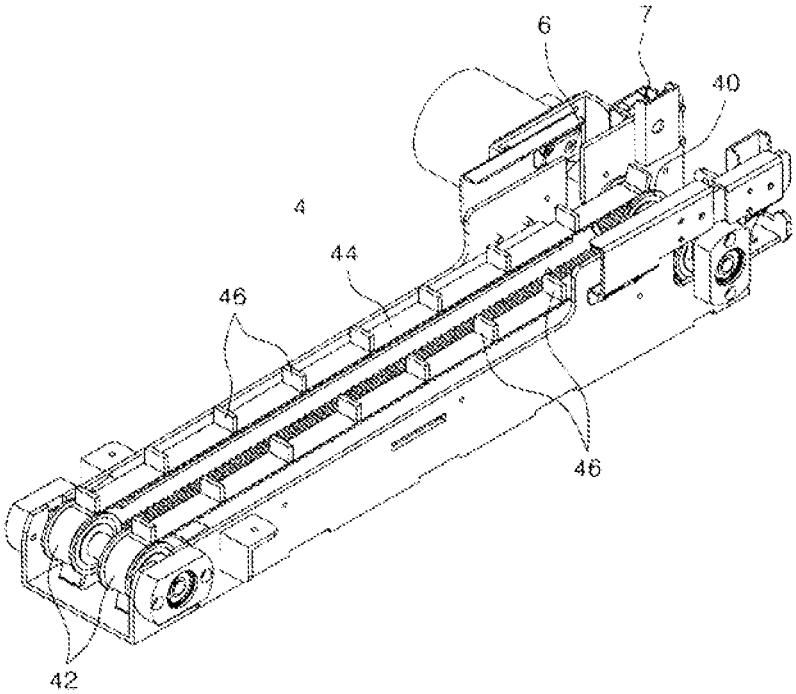
FIG. 4 is a perspective view showing the configuration of a loading unit shown, in FIG. 1.

FIG. 4 is a perspective view showing the configuration of the loading unit 4 applied in this embodiment.

Referring to FIG. 4, according to a preferred embodiment, the loading unit 4 may comprise a driving drum 40, a driven drum 42 spaced a predetermined distance from, the driving drum 40, and a belt body 44 connecting the driving drum 40 and the driven drum 42. The driving drum 40 corresponds to a drive shaft, and the belt body 44 is rotated by means of the driven drum 42 by the rotation of the driving drum 40 and moves a moving object placed thereon, i.e., the ball, from one side of the lading unit 4 to the other side.

When the belt body 44 rotates, the ball placed thereon may be separated from the belt body 44 or a plurality of balls may be moved together by inertial or impact/vibration during the movement. To prevent this, a plurality of guide members 45 may be formed on the surface of the belt body 44. Here, the guide members 46 may be spaced at intervals suitable to move the balls one by one.

Accordingly, each of the balls placed on the belt body 44 can be located in a space defined by adjacent, guide members 45 and moved from one side of the loading unit 4 to the other side without being separated or concentrated.

Meanwhile, the feeding members is located between the loading unit 4 and the mat unit 1 to receive the balls one by one from the loading unit 4 and supply the balls to the top of the inclined surface 10 of the mat unit 1 by a swing motion within a certain range. The feeding member will be described in more detail with reference to FIGS. 1 and 2 again.

The feeding member 5 applied in this embodiment comprises an operating arm 50 and a feeding arm 52 extending from the operating arms. Although not shown in the figure, one end of the operating arm 50 is hinge-connected to a power means for the swing motion. Accordingly, the operating arm 50 performs a swing motion in a clockwise or counterclockwise direction within a certain range with respect to a hinge point H. The feeding arm 52 is curved in the form of a hook and extends from the other end of the operating arm 50.

A receiving surface 52*a* is formed at a front end of the feeding arm 52 applied in this embodiment such that the balls provided by the loading unit 4 one by one can be stably provided to the mat unit 1. Here, the receiving surface 52*a* may be curved with a radius of curvature corresponding to the radius of the ball. In this case, the ball provided by the loading unit 4 can be accurately loaded on the inclined surface 10 formed on the mat unit 1 by the swing motion of the operating arm 50, while maintaining the stable loaded state on the receiving surface 52*a*.

Reference numerals 6 and 7 in FIGS. 1 and 2 denote a first sensor 6 for controlling the intermittent step motion of the loading unit 4 and a second sensor 7 involved in the swing motion of the feeding member 5.

In this embodiment, the first sensor 6 is located near an end of the loading unit 4 where the ball is placed and detects the presence of the ball placed on the belt body 44 at the end of the loading unit 4 before the ball is provided from the loading unit 4 to the feeding member 5. Upon detection of the ball, the first sensor 6 controls the operation of the loading unit 4 based on the detected signal. In detail, in the case where the ball is detected, the first sensor 6 controls the operation of the driving drum 40 that constitutes the loading unit 4 such that the belt body 44 performs a step motion by a predetermined distance.

Moreover, the second sensor 7 is located near the feeding member 5 at a height corresponding to the ball raised by the loading member 4 to detect the ball provided from the loading unit 4 and placed on the feeding member 5. Furthermore, the second sensor 7 controls the swing motion of the feeding member 5 based on the detected signal. In detail, the second sensor 7 controls the operation of a power means, not shown, involved in the swing motion of the feeding member 5.

A process in which a ball (golf ball) is supplied to a designated position (hole 12) by the ball supply device according to the present invention having the above-described configuration will be described in connection with the operation of the device according to the present invention.

Figure 5:
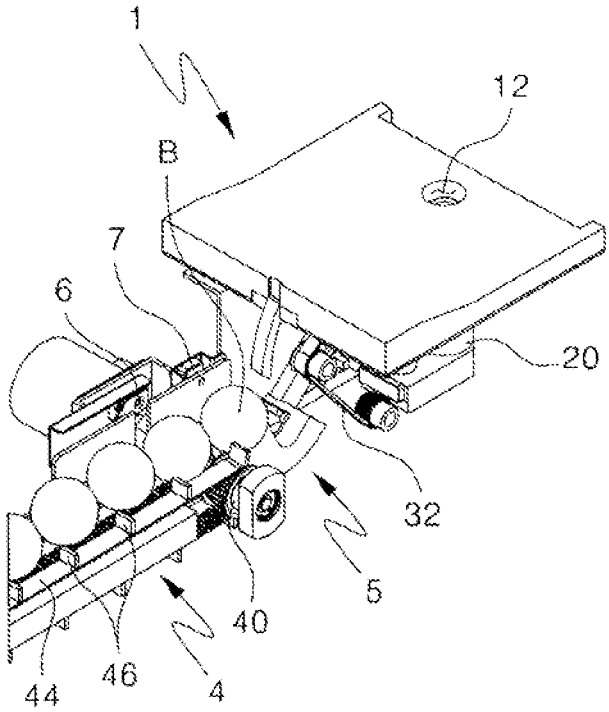
FIGS. 5 to 7 are schematic views showing a process in which a ball is supplied by a low-ground clearance-type ball supply device in accordance with an embodiment of the present invention.
Figure 5:
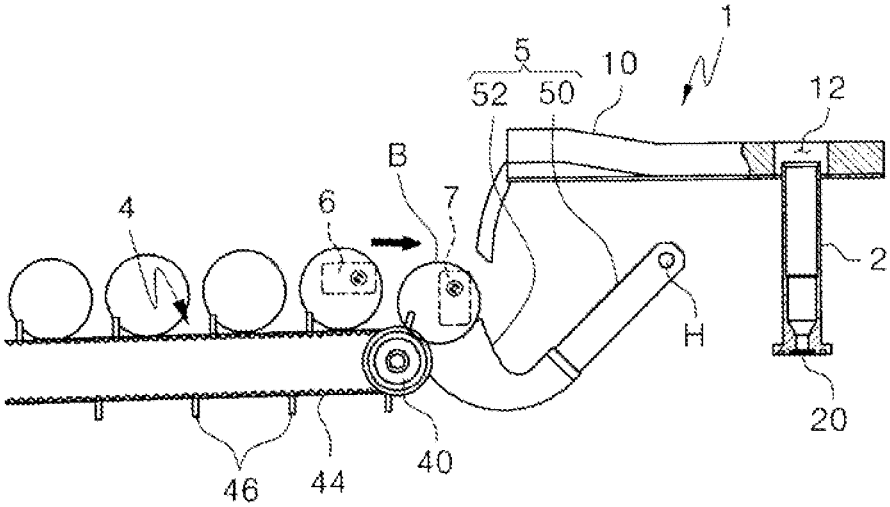
Figure 6:
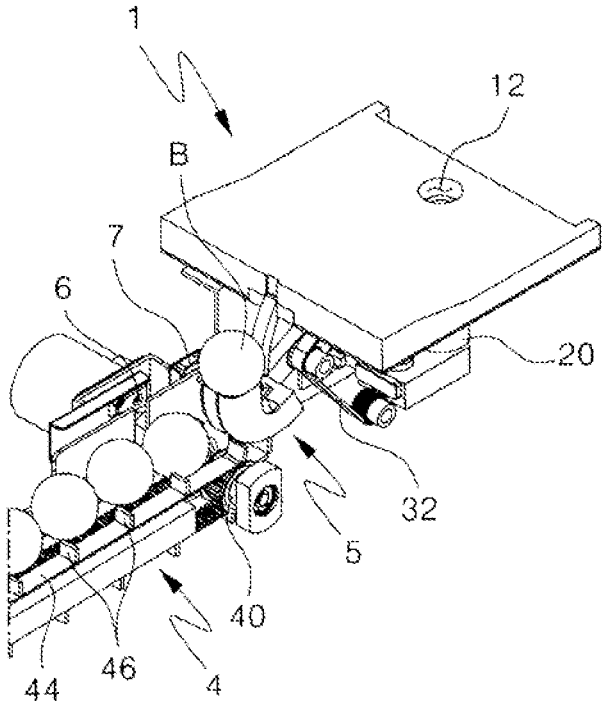
Figure 6:
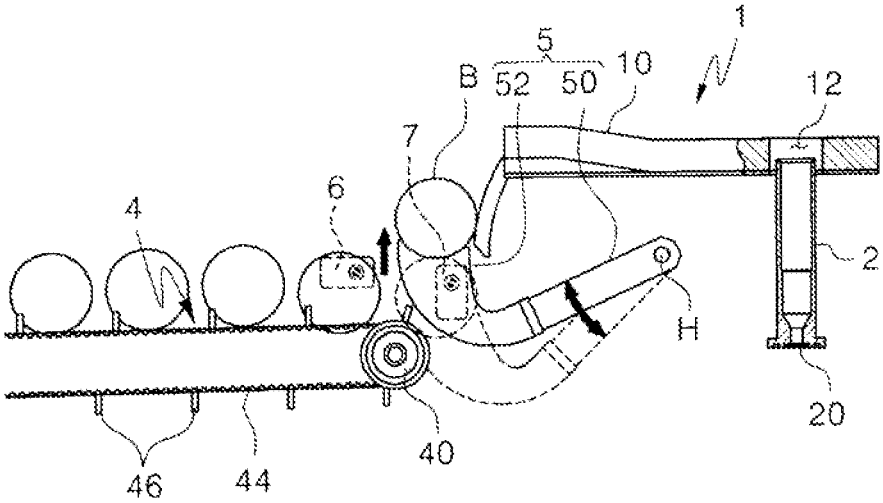
Figure 7:
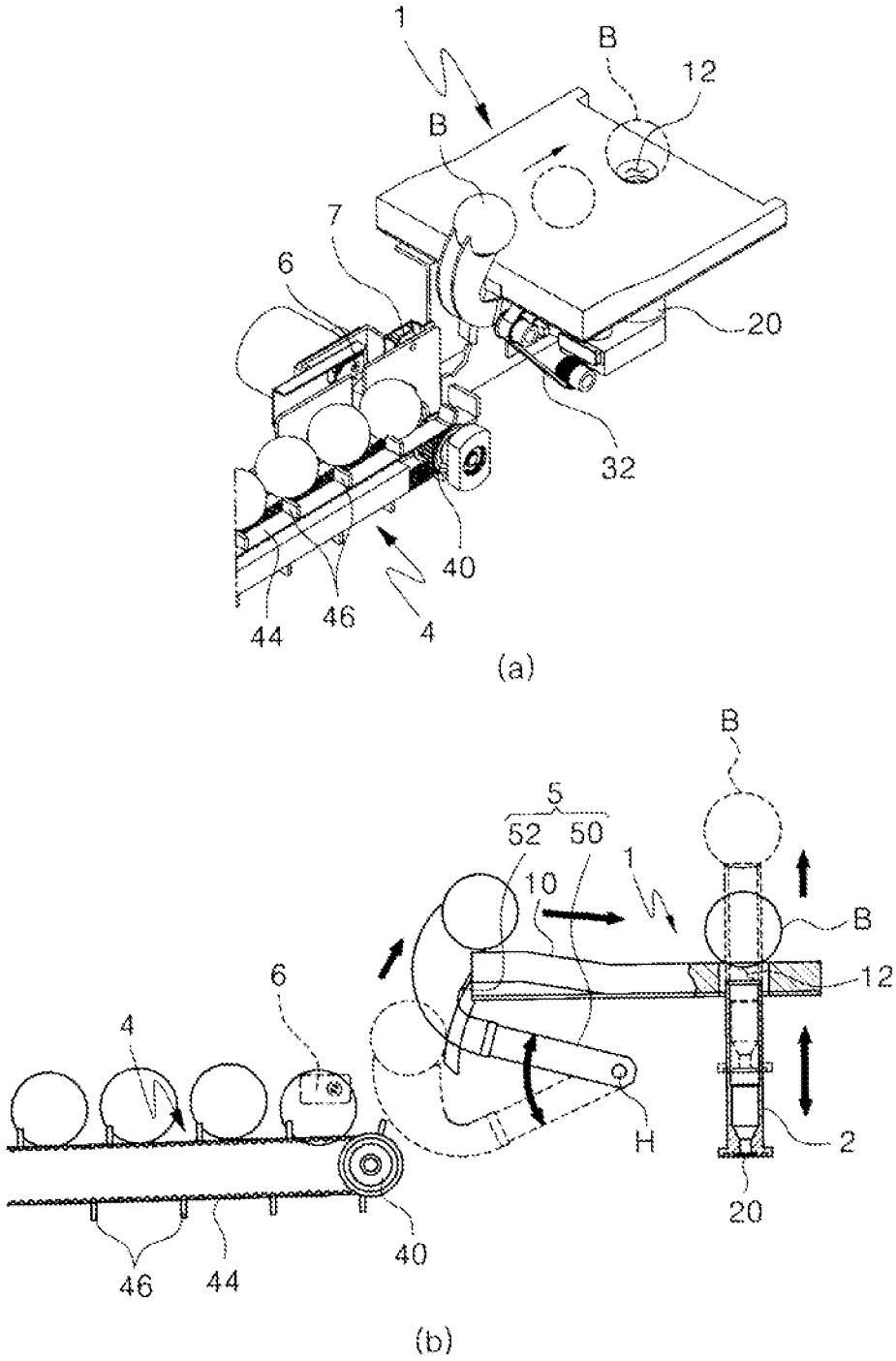

FIGS. 5 to 7 are schematic views showing the operation of the ball supply device according to the present invention. As can be seen from the figures, the ball placed on the belt body 44 is moved to a designated position in the order of the operations shown in FIGS. 5 to 7.

First, referring to FIG. 5, the ball placed on the tee member 2 and hit by a golfer is hit on the screen and is then collected in a hopper, not shown, along the inclined surface 10. The balls collected in the above manner are moved to the feeding member 5 one by one by the loading unit 4. When the ball B moved by the loading unit 4 is placed on the feeding member 5 as shown in FIG. 5, the second sensor 7 located near the feeding member 5 detects the ball B disposed on the feeding member 5, and the feeding member 5 is operated based on the detected signal to move the ball to a standby position shown in FIG. 6.

Then, the ball B standing by in the standby position as shown in FIG. 6 is supplied to the top of the inclined surface 10 of the mat unit 1 as shown in FIG. 7 by the swing motion of the feeding member 5 in response to an optional signal input by a user, e.g., an operation such as pressing a switch provided outside the device. The ball supplied to the top of the inclined surface 10 rolls down along the inclined surface 10 and is placed on the hole 12 (see the broken line of FIG. 7).

The tee member 2 is mounted in the hole 12 to be movable up and down and includes a sensor 20 therein. Accordingly, when a ball placed on the hole 12 is detected in a state where tee member 2 is located below the mat unit 1, the tee member 2 is moved upward outside the hole 12 along the axial line of the hole 12 based on the detected signal and, in this process, the ball B placed on the hole 12 is moved upward to a designated tee shot position by the tee member 2 (see the broken line of FIG. 7).

Meanwhile, although not shown in the figures, the feeding member 5 which has supplied the ball on the mat unit 1 returns to its initial position at which the ball is received from the loading unit 4 and, when the feeding member 5 returns to the initial position, the loading unit 4 performs the step motion under the control of the first sensor 6 and supplies the ball in the next order to the feeding member 5. Through the repeated process described above, the ball is automatically supplied to the designated tee shot position according to the user's selection.

According to the above-described embodiments of the present invention, the ball supply device of the present invention can be embedded on the floor in such a manner that the loading member supplying the balls is located on a plane lower than the mat unit where the ball is finally placed. Accordingly, the overall configuration of the device is not exposed on the floor or around the tee box, and thus it is possible to ensure much more clearance around the mat unit where the ball is placed.

Moreover, as the clearance is provided around the mat unit in the above manner, it is possible to provide an independent tee box space in both left and right sides with respect to the mat unit when the screen golf system is implemented, and thus it is advantageous to implement a tee box for both left-handed and right handed golfers.

Furthermore, when the device is provided below the mat unit, the device can be built at a lower height due to the application of the loading unit in the form of a conveyor belt. Accordingly, a high ground clearance is not required during installation of the device, and thus the device has no space restraints for the installation.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

The invention claimed is:

1. A low-ground clearance-type ball supply device configured to supply balls to a designated position one by one, the device comprising:

a mat unit which includes an inclined surface and a hole on which a ball provided along the inclined surface is located;

a tee member which is lifted up and down along an axial line of the hole in the mat unit and moves the ball located on the hole to a tee shot position spaced a predetermined distance upwardly from a plane of the matt unit;

a loading unit which is located on a plane lower than the mat unit and moves the ball loaded thereon to the mat unit; and a feeding member which is located between the loading unit and the mat unit and provides balls, which are provided from the loading unit one by one, to the inclined surface of the mat unit by a swing motion within a certain range, wherein the loading unit is a transfer device in the form of a conveyor belt that performs an intermittent step motion at a pitch suitable to supply the ball loaded thereon to the feeding member one by one.

2. The device of claim 1, further comprising a tee-up driving unit which moves up and down the tee member.

3. The device of claim 2, wherein the tee-up driving unit comprises:

a drive motor which operates in forward and reverse rotation within a certain rotation angle range; and an electrically-driven member which converts the rotational force by the drive motor into the up and down movement of the tee member.

4. The device of claim 3, wherein the tee member comprises a sensor which detects a ball placed on the hole in a state where the tee member is located below the mat unit.

5. The device of claim 4, wherein the tee-up driving unit is operated based on a detection command of the sensor.

6. The device of claim 1, wherein the loading unit comprises:

a driving drum;

a driven drum spaced a predetermined distance from the driving drum; and a belt body connecting the driving drum and the driven drum, wherein a plurality of guide members are formed on the surface of the belt body at intervals suitable to move the balls one by one from one side of the belt body to the other side.

7. The device of claim 1, wherein the feeding member comprises:

an operating arm which performs a swing motion in a clockwise or counterclockwise direction within a certain range with respect to a hinge point at one end thereof; and a feeding arm which is curved in the form of a hook from the other end of the operating arm and includes a receiving surface on which the ball provided one by one by the loading unit is placed.

8. The device of claim 7, wherein the receiving surface of the feeding arm is curved with a radius of curvature corresponding to the radius of the ball placed on the receiving surface.

9. The device of claim 1, further comprising:

a first sensor which controls the intermittent step motion of the loading unit; and a second sensor which is involved in the swing motion of the feeding member.

10. The device of claim 9, wherein the first sensor is disposed at an end of the loading unit with respect to the direction in which the ball is transferred.

11. The device of claim 9, wherein the second sensor is disposed near the feeding member at a height corresponding to the ball raised by the loading member when the ball provided from the loading unit is placed on the feeding member.

12. The device of claim 2, further comprising:

a first sensor which controls the intermittent step motion of the loading unit; and a second sensor which is involved in the swing motion of the feeding member.

13. The device of claim 3, further comprising:

a first sensor which controls the intermittent step motion of the loading unit; and a second sensor which is involved in the swing motion of the feeding member.

14. The device of claim 4, further comprising:

a first sensor which controls the intermittent step motion of the loading unit; and a second sensor which is involved in the swing motion of the feeding member.

15. The device of claim 5, further comprising:

a first sensor which controls the intermittent step motion of the loading unit; and a second sensor which is involved in the swing motion of the feeding member.

16. The device of claim 1, further comprising:

a first sensor which controls the intermittent step motion of the loading unit; and a second sensor which is involved in the swing motion of the feeding member.

17. The device of claim 6, further comprising:

a first sensor which controls the intermittent step motion of the loading unit; and a second sensor which is involved in the swing motion of the feeding member.

18. The device of claim 7, further comprising:

a first sensor which controls the intermittent step motion of the loading unit; and a second sensor which is involved in the swing motion of the feeding member.

19. The device of claim 8, further comprising:

a first sensor which controls the intermittent step motion of the loading unit; and a second sensor which is involved in the swing motion of the feeding member.

* * * * *